US006198799B1

(12) United States Patent
Ono et al.

(10) Patent No.: US 6,198,799 B1
(45) Date of Patent: Mar. 6, 2001

(54) X-RAY IMAGE FORMING METHOD AND X-RAY IMAGE FORMING SYSTEM

(75) Inventors: Koji Ono; Kouji Amitani, both of Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/237,147

(22) Filed: Jan. 25, 1999

(30) Foreign Application Priority Data

Jan. 30, 1998 (JP) ..... 10-019794

(51) Int. Cl.[7] ..... H05G 1/08
(52) U.S. Cl. ..... 378/98.2; 378/62; 378/98.8
(58) Field of Search ..... 378/62, 98.2, 98.8

(56) References Cited

U.S. PATENT DOCUMENTS

| | | | | |
|---|---|---|---|---|
| 4,234,670 | * | 11/1980 | Kaukeinen et al. | 430/52 |
| 4,905,265 | * | 2/1990 | Cox et al. | 378/98.8 |
| 4,908,520 | * | 3/1990 | Saotome et al. | 250/589 |
| 5,411,929 | * | 5/1995 | Ford et al. | 503/210 |
| 5,434,043 | | 7/1995 | Zou et al. | 430/619 |
| 5,440,130 | * | 8/1995 | Cox et al. | 250/370.09 |
| 5,736,293 | * | 4/1998 | Hirai et al. | 430/203 |

FOREIGN PATENT DOCUMENTS

| | | |
|---|---|---|
| 0 229 497 | 7/1987 | (EP) . |
| WO 91/10921 | 7/1991 | (WO) . |

OTHER PUBLICATIONS

"Imation DryView 8700 Laser Imaging System Product Data", Kodak Health Imaging, pp. 1–5, XP002104496, May 20, 1999.

Imation DryView Laser Imaging Film Product Data, Kodak Health Imaging, pp. 1–3, XP 002104497, Jun. 1, 1999.

* cited by examiner

*Primary Examiner*—David V. Bruce
*Assistant Examiner*—Allen C. Ho
(74) *Attorney, Agent, or Firm*—Frishauf, Holtz, Goodman, Langer & Chick, P.C.

(57) ABSTRACT

An x-ray image forming method is disclosed. The x-ray image is captured employing a flat panel detector; from this panel detector, the x-ray image taken out in the form of image signals; employing a thermally developable photosensitive material comprising photosensitive silver halide grains, a non-photosensitive reducible silver source, and a reducing agent for the silver source, the above-mentioned image signals are converted into variation in light intensity and recorded onto the photosensitive silver halide grains; the x-ray image is obtained by heating in the presence of a non-photosensitive reducible silver source and a reducing agent for the silver source.

20 Claims, 4 Drawing Sheets

X-RAY IMAGE FORMING METHOD AND X-RAY IMAGE FORMING SYSTEM

FIELD OF THE INVENTION

The present invention relates to an x-ray image forming method and an x-ray image forming system, which are employed for x-ray mammography and radiography of the limbs, bones, etc.

BACKGROUND OF THE INVENTION

As the x-ray image forming system which is employed for mammography or radiography of the limbs, bones, etc., an x-ray image is captured employing a flat panel detector and the x-ray image is taken out from the flat panel detector in the form of image signals, which, for example, is subjected to thermal fusion transfer employing a thermal head.

In the x-ray image forming system in which an x-ray image is captured employing a flat panel detector and the resulting x-ray image is taken out from this flat panel detector, the detector having extremely excellent sharpness is employed. However, a thermal fusion transfer system employing, for example, a thermal head has not resulted in sufficient sharpness.

Furthermore, there is the thermal fusion transfer system, in which, for example, the transfer is carried out by placing a recording sheet on an image receiving film employing a recording drum. However, there have been problems such that the device becomes expensive and in addition, image formation is not quick enough. Accordingly, it has been impossible to realize the excellent sharpness of the flat panel detector employing a low cost device.

SUMMARY OF THE INVENTION

An object of the present invention is to provide an x-ray image forming method and an x-ray image forming system, in which a high quality x-ray image with excellent sharpness and high resolution, required for mammography and radiography of the limbs, bones, etc., is obtained quickly and surely, moreover employing a low cost device.

In an x-ray image forming method of the invention, an x-ray image is captured employing a flat panel detector; from said flat panel detector, said x-ray image is taken out in the form of an image signal; upon converting said image signal to variation in light intensity, employing a thermally developable photosensitive material basically comprising photosensitive silver halide, a non-photosensitive reducible silver source, and a reducing agent for said silver source, said x-ray image is recorded in photosensitive silver halide grains; the resulting grains are heated in the presence of said non-photosensitive reducible silver source and said reducing agent for the said source to obtain an x-ray image.

The x-ray image forming method of the invention comprises steps of;

- capturing an x-ray image by a flat panel detector,
- reading an x-ray image from the flat panel in the form of an image signal,
- converting the x-ray image signal to light signal,
- exposing a thermally developable photosensitive material comprises a light sensitive silver halide grains, a non-photosensitive reducible silver source and a reducing agent for the silver source according to the light signal,
- heating the exposed thermally developable photosensitive material to obtain an x-ray image.

According to the invention, it is possible to quickly and surely obtain a high quality x-ray image with excellent sharpness and high resolution required, for example, for mammography, and radiography of the limbs, the bones, etc. by recording the x-ray image in photosensitive silver halide grains and thermally developing the recorded image in the presence of a non-photosensitive silver source and a reducing agent for the silver source.

In an x-ray image forming system, wherein an x-ray image is captured using a flat panel detector, and from said flat panel detector, said x-ray image is taken out in the form of an image signal, an x-ray image forming system characterized in that said x-ray image signal is converted to variation in light intensity which is recording on photosensitive silver halide grains in a thermally developable photosensitive material and a thermal development device is provided, in which an x-ray image is obtained by heating in the presence of a non-photosensitive reducible silver source and a reducing agent for said silver source.

The x-ray image forming system of the invention comprises;

- a flat panel detector which captures an x-ray image, and from said flat panel detector, reading out device to take out an x-ray image from the flat panel in the form of an image signal,
- a converting device which converts the x-ray image signal to light signal,
- an exposing device which exposes a thermally developable photosensitive material comprises a light sensitive silver halide grains, a non-photosensitive reducible silver source and a reducing agent for the silver source according to the light signal,
- a heating device which thermally develops the exposed thermally developable photosensitive material.

According to this, it is possible to quickly and surely obtain a high quality x-ray image with excellent sharpness and high resolution, required for, for example, mammography, radiography of the limbs, the bones, etc., moreover, employing a low cost device, by recording the x-ray image on photosensitive silver halide grains and thermally developing the thermally developable photosensitive material while being heated in the presence of a non-photosensitive silver source and a reducing agent for the silver source.

In an x-ray image forming system thermal development device is provided with a conveyance means which conveys said thermally developable photosensitive material, an exposure means which exposes photosensitive silver halide grains of said thermally developable photosensitive material, a heating means which supplies heat to both of a non-photosensitive reducible silver source and a reducing agent for the silver source in said thermally developable photosensitive material, and a control means which controls said conveyance means, said exposure means, and said heating means, and said thermally developable photosensitive material is thermally developed to obtain an x-ray image.

So the x-ray image forming system comprises

- a conveyance device which conveys said thermally developable photosensitive material,
- an exposure device which exposes the thermally developable photosensitive material,
- a heating device which supplies heat to the thermally developable photosensitive material comprising a light sensitive silver halide grains, a non-photosensitive reducible silver source and a reducing agent for the silver source, and
- a control device which controls said conveyance device, said exposure device, and said heating device.

According to the invention described, by conveying a thermally developable photosensitive material, recording an x-ray image on photosensitive silver halide grains through exposure, and thermally developing the thermally developable photosensitive material upon being heated in the presence of a non-photosensitive silver source and a reducing agent for the silver source, it is possible to quickly and surely obtain a high quality x-ray image with excellent sharpness and high resolution required, for example, for mammography, radiography of the limbs, the bones, etc., moreover, employing a low cost device.

DESCRIPTION OF THE INVENTION

The embodiments of the x-ray image forming method and the x-ray image forming system are described with reference to Figs. below.

Figure 1:
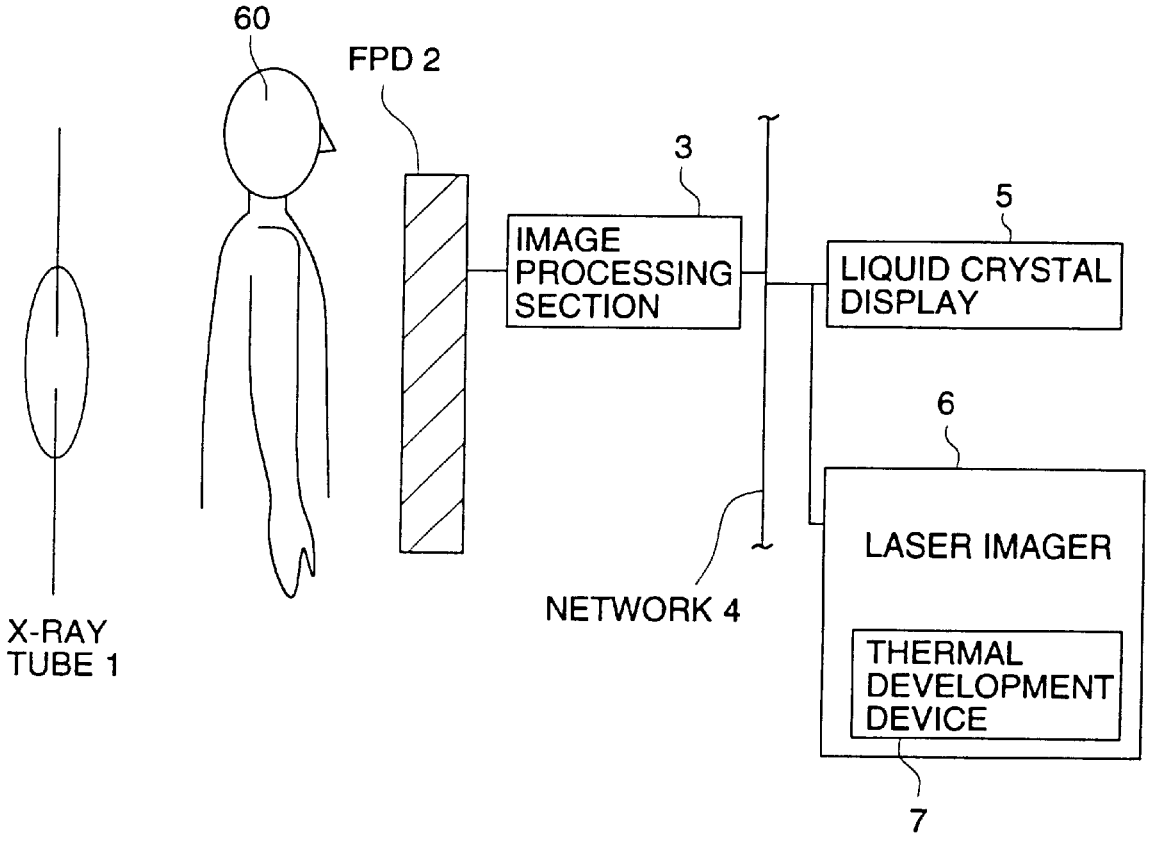
FIG. 1 is a schematic constitution view of an x-ray image forming system.

The x-ray image forming system, as shown in FIG. 1, is constituted in such a way that a subject 60 is photographed employing an x ray emitted from an x-ray tube 1 and an x-ray image is captured employing a flat panel detector (FPD); the x-ray image is taken out from this flat panel detector (FPD) in the form of image signals, which are subjected to image processing in an image processing section 3 and transmitted to a network 4. The network 4 is connected with a liquid crystal display 5, a laser imager 6, etc. The liquid crystal displays the x-ray image and the x-ray image is outputted in the form of a print employing the laser imager 6. The imager comprises a thermal development device 7.

Figure 3:
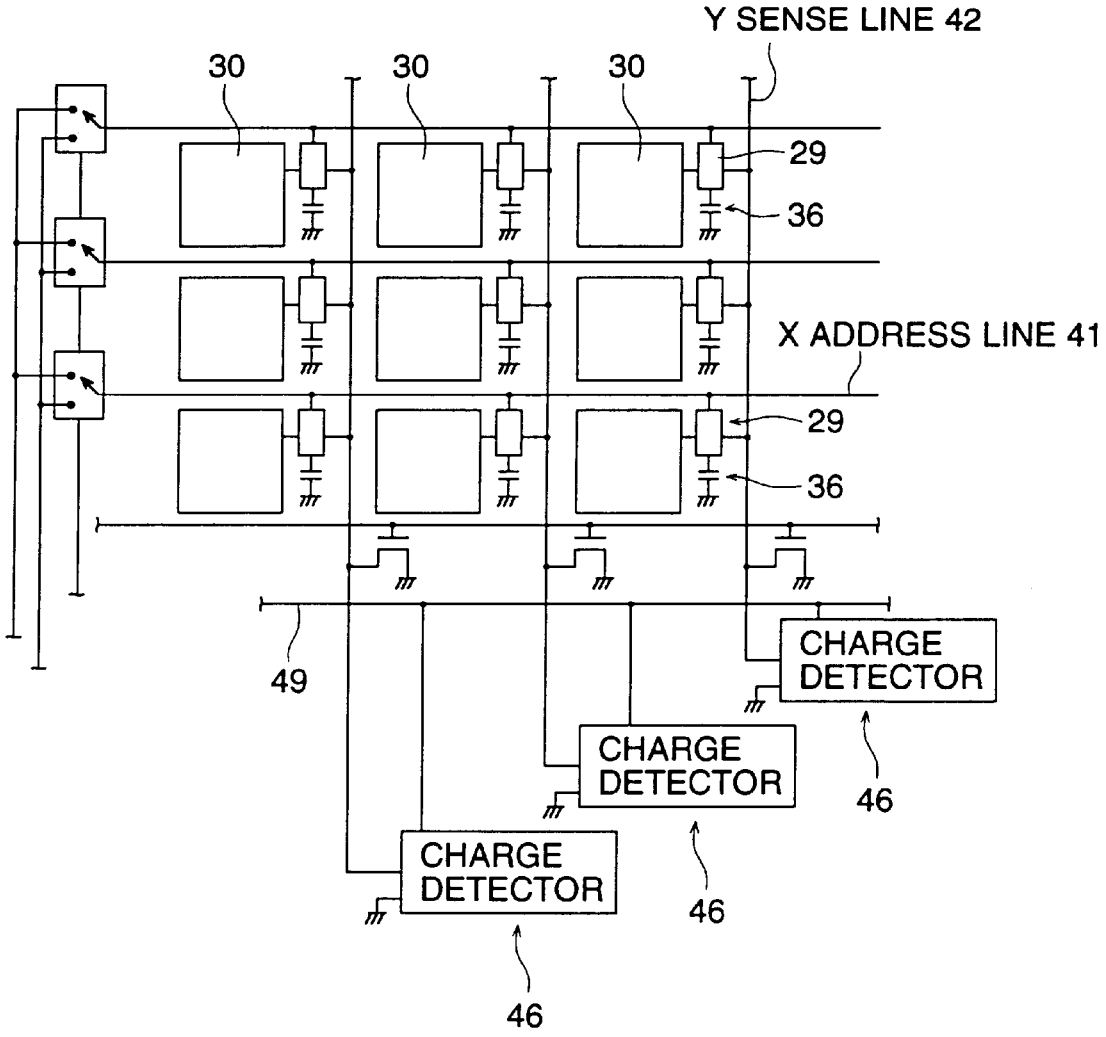
FIG. 3 is a schematic top view of the flat panel detector (FPD).
Figure 4:
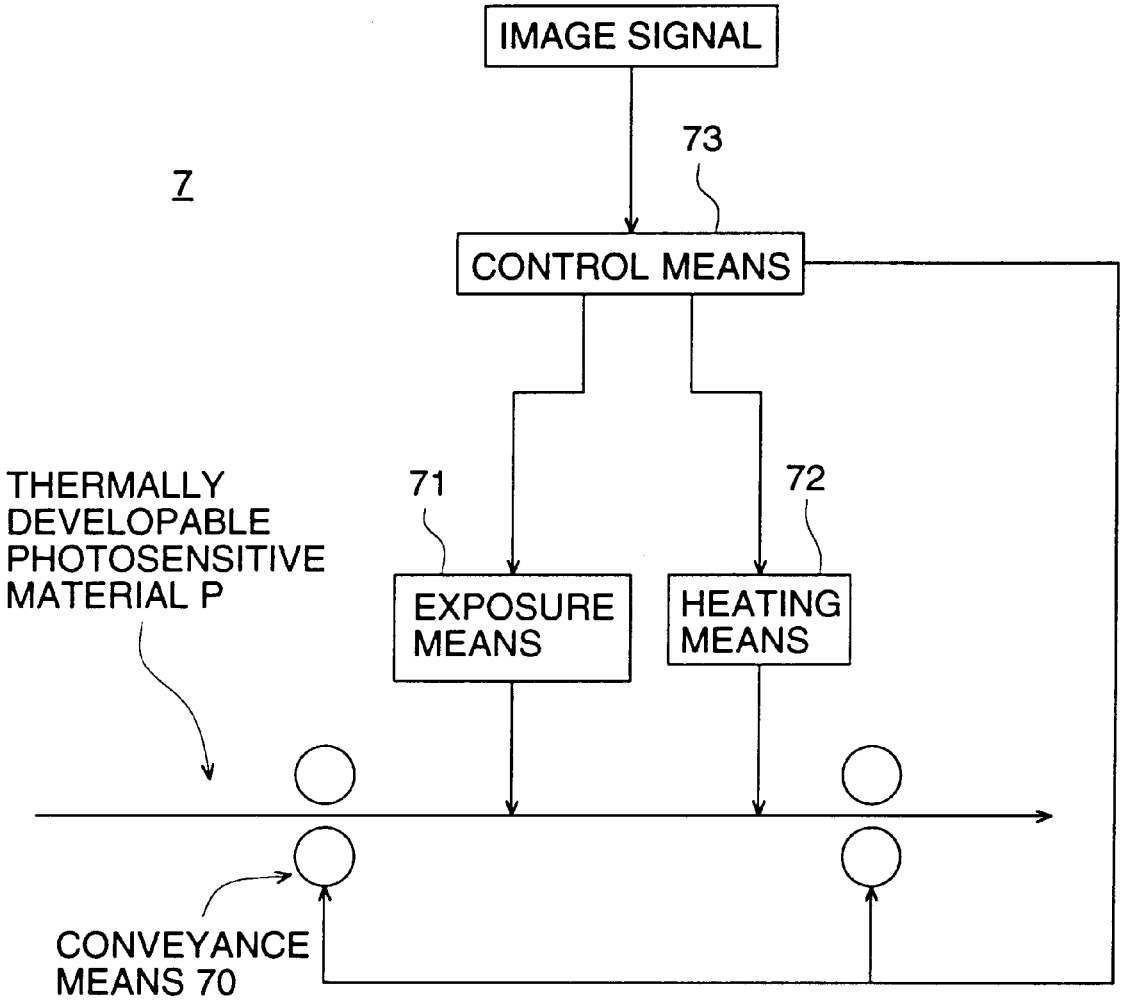
FIG. 4 is a schematic constitution view of a thermal development device.

The flat panel detector (FPD) 2 is constituted as shown in FIGS. 3 and 4.

Figure 2:
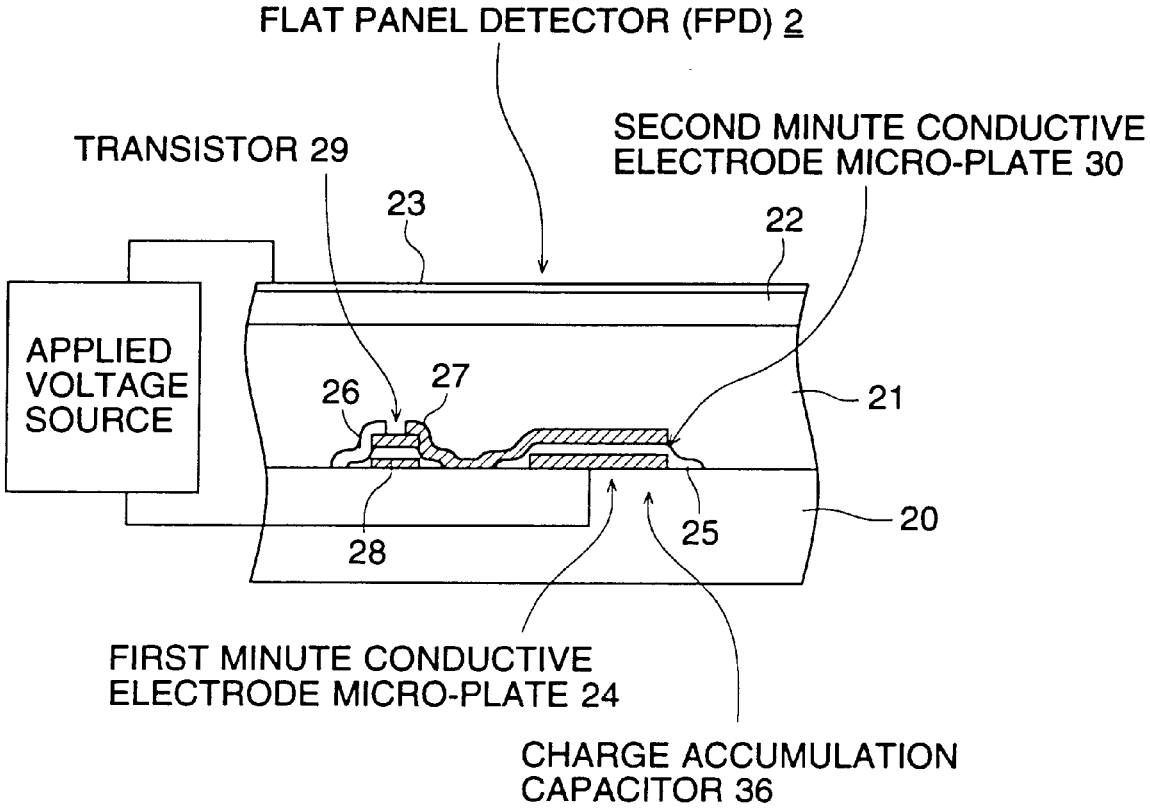
FIG. 2 is a schematic sectional view showing a flat panel detector (FPD).

The flat panel detector (FPD) 2, as shown in FIG. 2, is constituted by layering, on a dielectric substrate layer 20, a photoconductive layer 21, a dielectric layer 22, and a front surface conductive layer 23 in this order. On the dielectric substrate layer 20, a plurality of first minute conductive electrode micro-plates 24 are provided. The contour of the smallest pixel, which the flat panel detector 2 can resolve, is determined depending on the sizes of this first minute conductive micro-plate. On a plurality of the first minute conductive micro-plates 24, an electrostatic capacity dielectric material 25 is formed. Though the dielectric layer 22 should be removed from the flat panel director 2, an x-ray image can be formed and the present invention can be realized. However, in such a case, there is possibility of some decrease in holding properties of the charge amount accumulated employing an electric charge accumulation capacitors 36 and the sharpness of the x-ray image.

Furthermore, on the dielectric substrate layer 20, a plurality of transistors having two electrodes 26 and 27 and a gate 28 are layered. In addition, on the dielectric substrate layer 20, a plurality of second minute conductive electrode micro-plates 30 are layered.

As shown in FIG. 3, at least one transistor 29 is connected with a plurality of the second minute conductive electrode micro-plates 30 with X address lines 41 and Y sense lines 42. The charge accumulation capacitors 36 are composed of the first minute conductive electrode micro-plate 24, the second minute conductive micro-plate 30, and the electrostatic capacity dielectric material 25. The second minute conductive electrode micro-plate 30 is also connected with the electrode 27 of the transistor 29. The first minute conductive electrode micro-plate 24 is with a grounded cable.

The transistor 29 works as a bi-directional switch and allows to run electricity between Y sense lines 42 and the charge accumulation capacitors 36 depending on whether voltage is applied to the gate via the X address lines 41 or not.

In the space between a plurality of the second minute conductive electrode micro-plates 30, the conductive electrode or the X address lines 41 and the Y sense lines 42 are arranged. The X address lines 41 and the Y sense lines 42 are arranged so as to be in a right angle with each other. The X address lines 41 and the Y sense lines 42 are individually accessible along with the side or edge of the flat panel defector (FPD) 2 through a lead or a connector.

Bias voltage is applied to each of the X address lines 41. Accordingly, address is successively carried out by applying voltage to the gate of the transistor 29 connected with the X address lines 41 which are subjected to address. By doing so, the transistor 29 is turned on and charges accumulated in the corresponding charge accumulation capacitors 36 flow to the Y sense lines 42 as well as to the output side of a charge detector 46. The charge detector 46 generates voltage output proportional to charges detected on the Y sense lines 42. The output of the charge detector 46 is successively subjected to sampling, and image signals are obtained, which express the charge distribution of a micro-capacitors on the X address lines 41 which are subjected to address, and each micro-capacitor displays one image pixel. When signals are read form the lines in which pixels are present on the X address lines 41, a charge amplifier is reset through a reset line 49. The following X address line 41 is subjected to address and this process is repeated until entire charge accumulation capacitors 36 are subjected to sampling, and an entire image is read.

As shown in FIG. 4, the laser imager 6 is provided with the thermal development device 7. FIG. 4 is a schematic constitution view of the thermal development device.

The thermal development device 7 is provided with a conveyance means 70 which conveys a thermally developable photosensitive material P, an exposure means 71 which gives exposure onto photosensitive silver halide grains of the thermally developable photosensitive material P to result in recording, a heating means 72 which supplies heat to a non-photosensitive reducible silver source and a reducing agent for the silver source of the thermally developable photosensitive material P, and a control means 73 which controls the conveyance means 70, the exposure means 71, and the heating means 72, and thermally develops the thermally developable photosensitive material P to obtain x-ray images.

In this thermal development device 7, the thermally developable photosensitive material P is conveyed; is subjected to image exposure onto the photosensitive silver halide grains; is then subjected to heating in the presence of the non-photosensitive reducible silver source and the reducing agent for the source, and is subjected to thermal development to quickly and surely obtain high quality x-ray images with excellent sharpness and high resolution required for, for example, mammography, radiograph of the limbs, and bones, etc., moreover, employing a low cost device.

The thermally developable photosensitive material of the present invention is described in detail below. The thermally developable photosensitive material of the present invention basically comprises photosensitive silver halide, a non-photosensitive reducible silver source, and a reducing agent for the silver source, and forms images employing a thermally developable processing method. The thermally developable photosensitive materials are disclosed in detail, for example, in U.S. Pat. Nos. 3,152,904 and 3,457,075, and D. Morgan, "Dry Silver Photographic Material", D. Morgan and B. Shely, "Thermally Processed Silver Systems" (Imaging Processes and Materials, Neblette 8th edition, edited by Sturge, V. Walworth, A. Shepp, page 2, 1969).

The photosensitive silver halide grains in the present invention are described below. In the present invention, in order to minimize the translucence after image formation and to obtain excellent image quality, the average grain size is preferably minute. The average grain size is preferably not more than 0.1 $\mu$m. The grain size as described herein implies the ridge line length of a silver halide grain when it is a so-called regular crystal which is either cubic or octahedral. Furthermore, when the silver halide grain is a tabular grain, the grain size is the diameter of a sphere having the same area as the projection area of the main surface. Silver halide is preferably monodispersed. The monodisperse as described herein means that the degree of monodispersibility obtained by the formula described below is not more than 40 percent. The more preferred grains are those which exhibit the degree of monodispersibility is not more than 30 percent, and the particularly preferred grains are those which exhibit a degree of monodispersibility is between 0.1 and 20 percent.

Degree of monodispersibility=(standard deviation of grain diameter)/(average of grain diameter)×100

As shapes of silver halide grains, listed can be cubic, octahedral, tabular grains, spherical grains, cylindrical grains, potato-shaped grains, and the like. In the present invention, cubic grains and tabular grains are particularly preferred. When the tabular silver halide grains are employed, the average aspect ratio is preferably between 2 and 100, and is more preferably between 3 and 50. These are described in U.S. Pat. Nos. 5,264,337, 5,314,798, 5,320,958, etc., and desired tabular grains are readily obtained. Furthermore, silver halide grains having round corners are preferably employed. There is no particular limitation on the outer surface of a silver halide grain. However, a high ratio occupying a Miller index [100] plane is preferred. This ratio is preferably not less than 50 percent; is more preferably at least 70 percent, and is most preferably at least 80 percent. The ratio occupying the Miller index [100] plane can be obtained based on T. Tani, J. Imaging Sci., 29, 165 (1985) in which adsorption dependency of a [111] plane and a [100] plane is utilized.

The composition of silver halide is not particularly limited and may be any of silver chloride, silver chlorobromide, silver chloroiodobromide, silver bromide, silver iodobromide, or silver iodide. In the present invention, silver bromide or silver iodobromide may be preferably employed. Particularly, silver iodobromide is preferably employed; the content of silver iodide is preferably between 0.1 and 40 mole percent, and is more preferably between 0.1 and 20 mole percent. The distribution of the halogen composition in a grain may be uniform and may continuously vary. As a preferred example, silver iodobromide grains having a high content ratio of silver iodide toward the interior are employed. Furthermore, silver halide grains having a core/shell structure may be preferably employed.

The photographic emulsion employed in the present invention can be prepared employing methods described in P. Glafkides, "Chimie et Physique Photographique" (published by Paul Montel, 1967), G. F. Duffin, "Photographic Emulsion Chemistry" (published by The Focal Press, 1966), V. L. Zelikman et al., "Making and Coating Photographic Emulsion (published by The Focal Press, 1964), etc. Namely, any of several acid emulsions, neutral emulsions, ammonia emulsions, and the like may be employed. Furthermore, when grains are prepared by allowing soluble silver salts to react with soluble halide salts, a single-jet method, a double-jet method, or combinations thereof may be employed. The resulting silver halide may be incorporated into an image forming layer utilizing any practical method, and at such time, silver halide is placed adjacent to a reducible silver source.

Furthermore, silver halide may be prepared by converting a part or all of the silver in an organic silver salt formed through the reaction of an organic silver salt with halogen ions into silver halide. Silver halide may be previously prepared and the resulting silver halide may be added to a solution to prepare the organic silver salt, or combinations thereof may be used, however the latter is preferred. Generally, the content of silver halide in the organic silver salt is preferably between 0.75 and 30 weight percent.

Silver halide employed in the present invention is preferably comprised of complexes of metals selected from Fe, Co, Ni, Ru, Rh, Re, Os, and Ir, and one type metal complex or at least two of same type or different types of metal compounds in combinations may be employed. The content is preferably in the range of $1\times10^{-9}$ to $1\times10^{-2}$ mole per mole of silver, and is more preferably in the range of $1\times10^{-8}$ and $1\times10^{-4}$ mole.

In the present invention, regarding the transition metal complexes, six-coordinate complexes represented by the general formula described below are preferred.

General formula $(ML_6)^m$;

wherein M represents a transition metal selected from elements in Groups 6 through 10 of the Periodic Table; L represents a coordinating ligand; and m represents 0, 1-, 2-, 3-, or 4-. Specific examples represented by L include halides (fluorides, chlorides, bromides, and iodides), cyanides, cyanatoes, thiocyanatoes, selenocyanatoes, tellurocyanatoes, each ligand of azido and aquo, nitrosyl, and thionitrosyl, etc., of which aquo, nitrosyl and thionitrosyl are preferred. When the aquo ligand is present, one or two ligands are preferably coordinated. L may be the same or different.

The preferred specific examples, when M is rhodium (Rh), ruthenium (Ru), rhenium (Re) or osmium (Os), are described.

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[CrCl_6]^{4-}$
7: $[Ru(NO)Cl_5]^{2-}$
8: $[RuBr_4(H_2O)]^{2-}$
9: $[Ru(NO)(H_2O)Cl_4]^-$
10: $[RhCl_5(H_2O)]^{2-}$
11: $[Re(NO)\ Cl_5]^{2-}$
12: $[Re(NO)CN_5]^{2-}$
13: $[Re(NO)ClCN_4]^{2-}$
14: $[Rh(NO)_2C1_4]^-$
15: $[Rh(NO)(H_2O)Cl_4]^-$

16: $[Ru(NO)CN_5]^{2-}$
17: $[Fe(CN)_6]^{3-}$
18: $[Rh(NS)Cl_5]^{2-}$
19: $[Os(NO)Cl_5]^{2-}$
20: $[Cr(NO)Cl_5]^{2-}$
21: $[Re(NO)Cl_5]^{-}$
22: $[Os(NS)Cl_4(TeCN)]^{2-}$
23: $[Ru(NS)Cl_5]^{2-}$
24: $[Re(NS)Cl_4(SeCN)]^{2-}$
25: $[Os(NS)Cl(SCN)_4]^{2-}$
26: $[Ir(NO)Cl_5]^{2-}$

Regarding cobalt and iron compounds, hexacyano metal complexes can be preferably used. Specific examples are described below.

27: $[Fe(CN)_6]^{4-}$
28: $[Fe(CN)_6]^{3-}$
29: $[Co(CN)_6]^{3-}$

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are most preferably added at the stage of nuclei formation. The addition may be carried out several times by dividing the added amount. Incorporation can be carried out so as to result in uniform content in the interior of a silver halide grain. As described in Japanese Patent Publication Open to Public Inspection No. 63-29603, 2-306236, 3-167545, 4-76534, 6-110146, 5-273683, etc., incorporation can preferably be carried out so as to result in distribution formation in the interior of a grain. These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KC1 is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions.

Specifically, the preferred method is such that an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

Photosensitive silver halide grains can be desalted employing methods known in the art such as a noodle method, a flocculation method, a ultrafiltration method, an electrodialysis, etc.

The photosensitive silver halide grains in the present invention are preferably subjected to chemical sensitization employing sensitizing methods known in the art such as sulfur sensitization, selenium sensitization, tellurium sensitization, noble metal sensitization, reduction sensitization, etc. Furthermore, these sensitizing methods are employed in combinations of two or more. In the sulfur sensitization, employed can be thiosulfate salts, thiourea compounds, inorganic sulfur, etc. As compounds preferably employed in the selenium sensitization and tellurium sensitization, those described in Japanese Patent Publication Open to Public Inspection No. 9-230527 can be listed. As compounds preferably employed in the noble metal sensitization, listed can be, for example, chloroauric acid, potassium chloroaurate, potassium aurithiocyanate, gold sulfide, gold selenide, or compounds described in U.S. Pat. No. 2,448,060, U.K. Patent 618,061, etc. As specific compounds for the reduction sensitization method, employed are ascorbic acid, thiourea dioxide, stannous chloride, hydrazine derivatives, borane compounds, silane compounds, polyamine compounds, etc. In addition, the reduction sensitization can be carried out. The reduction sensitization can also be carried our by keeping the pH and pAg of an emulsion at not less than 7 and not more than 8.3, respectively.

Into the thermally developable photosensitive material of the present invention, as spectral sensitizing dyes, employed can be cyanine dyes, merocyanine dyes, complex cyanine dyes, complex merocyanine dyes, holopolar cyanine dyes, styryl dyes, hemicyanine dyes, oxonol dyes, and hemioxonol dyes. Sensitizing dyes can be employed, which are described, for example, in Japanese Patent Publication Open to Public Inspection Nos. 63-159841, 60-140335, 63-231437, 63-259651, 63-304242, and 63-15245; U.S. Pat. Nos. 4,639,414, 4,740,455, 4,741,966, 4,751,175, and 4,835,096.

Useful sensitizing dyes employed in the present invention are described, for example, in publications described in or cited in Research Disclosure Items 17643, Section IV-A (page 23, December 1978), 1831, Section X (page 437, August 1978). Particularly, selected can advantageously be sensitizing dyes having the spectral sensitivity suitable for spectral characteristics of light sources of various types of laser imagers or scanners. For example, dyes are preferably selected, which are described, for example, in Japanese Patent Publication Open to Public Inspection Nos. 9-34078, 9-54409, and 9-80676.

Useful cyanine dyes are, for example, those having a basic nucleus such as a thiazoline nucleus, an oxazoline nucleus, a pyrroline nucleus, a pyrisidine nucleus, an oxazole nucleus, a thiazole nucleus, selenazole nucleus, an imidazole nucleus, etc. Famous merocyanine dyes which are preferred comprise acidic nuclei such as a thiohydantoin nucleus, a rhodanine nucleus, an oxazolidinedione nucleus, a thiazolinedione nucleus, a barbituric acid nucleus, a thiazolinone nucleus, a malononitrile nucleus, a pyrazolone nucleus, etc. in addition to the above-mentioned basic nuclei.

These sensitizing dyes may be employed individually or in combinations thereof. The combinations of sensitizing dyes are frequently employed for the purpose of supersensitization. The compounds which exhibit no spectral sensitizing action or substantially absorb no visible light and exhibit supersensitization may be incorporated into an emulsion. Useful sensitizing dyes, combinations of dyes which exhibit supersensitization, and substances which exhibit supersensitization are described in Research Disclosure, Volume 176, 17643 (published in December 1978), page 23, J Section of 1V or the above-mentioned Japanese Patent Publication Nos. 9-25500 and 43-4933, Japanese Patent Publication Open to Public Inspection Nos. 59-19032 and 59-192242, etc.

In the present invention, organic silver salts are reducible silver sources and preferred are organic acids and silver salts of hetero-organic acids having a reducible silver ion source, specifically, long chain (having from 10 to 30 carbon atoms, but preferably from 15 to 28 carbon atoms) aliphatic carboxylic acids. Organic or inorganic silver salt complexes are also useful in which the ligand has a total stability constant for silver ions of 4.0 to 10.0. Examples of preferred silver salts are described in Research Disclosure, Items 17029 and 29963, and include the following; silver salts of organic acids (for example, salts of gallic acid, oxalic acid, behenic acid, stearic acid, palmitic acid, lauric acid, oleic acid, caproic acid, myristic acid, palmitic acid, maleic acid, linoleic acid, etc.); silver carboxyalkylthiourea salts (for example, 1-(3-carboxypropyl)thiourea, 1-(3-carboxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid), silver salts or complexes of thioenes (for example, 3-(2-carboxyethyl)-4-hydroxymethyl-4-(thiazoline-2-thioene and 3-carboxymethyl-4-thiazoline-2-thioene), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these, the particularly preferred silver source is silver behenate.

Organic silver salts can be prepared by mixing a water-soluble silver compound with a compound which forms a complex with silver, and employed preferably are a normal precipitation, a reverse precipitation, a double-jet precipitation, a controlled double-jet precipitation as described in Japanese Patent Publication Open to Public Inspection No. 9-127643, etc.

There is no particular limitation on the shape of the organic silver salt which can be employed in the present invention, but needle crystals having short and long axes are preferred. As is well known in photosensitive silver halide materials, the inverse proportion relationship between the size of a silver salt crystal and the covering power thereof is valid for the thermally developable photosensitive material of the present invention. Namely, when the size of organic silver salt grain in the image forming part of the thermally developable photosensitive material is large, its covering power is small to result in a decrease in image density. Accordingly, it is required to decrease the size of the organic silver salt.

In the present invention, the short axis is preferably between 0.01 and 0.20 $\mu$m and the long axis is preferably between 0.10 and 5.0 $\mu$m, and the short axis is more preferably between 0.01 and 0.15 $\mu$m and the long axis is more preferably between 0.10 and 4.0 $\mu$m. The size distribution of the organic a silver salt is preferably of monodisperse. The monodisperse as described herein is that the percent of a value obtained by dividing the standard deviations of a short axis length and a long axis length by the short axis length and the long axis length, respectively, are preferably not more than 100 percent, and are more preferably not more than 80 percent, and are most preferably not more than 50 percent. The shape of an organic silver salt can be measured employing a transmission type electron microscope for an organic silver salt dispersion. As another method to measure the monodispersibility, there is a method in which the standard deviation of a volume weighted average diameter is obtained. The percent (variation coefficient) of a value obtained by dividing by the volume weighted average diameter is preferably not more than 100 percent, is more preferably not more than 89 percent, and is most preferably 50 percent. As a measurement method, for example, a laser beam is irradiated onto an organic salt dispersed in a liquid, and the monodispersibility can be obtained from the grain size (volume weighted average diameter) which is obtained by measuring an auto-correlation coefficient for the time variation of fluctuation of the scattered light. The coated amount of the organic silver salt, specifically organic acid silver, is preferably between 0.5 and 5.0 g per $m^2$ of the photosensitive material, and is more preferably between 1.0 and 3.0 g.

Examples of reducing agents suitable for the thermally developable photosensitive material of the present invention are described in U.S. Pat. Nos. 3,770,448, 3,773,512, and 3,593,863, and Research Disclosure Items 17029 and 29963, and include the following.

Aminohydroxycycloalkenone compounds (for example, 2-hydroxypiperidino-2-cyclohexane); esters of amino reductones as the precursor of reducing agents (for example, piperidinohexose reducton monoacetate); N-hydroxyurea derivatives (for example, N-p-methylphenyl-N-hydroxyurea); hydrazones of aldehydes or ketones (for example, anthracenealdehyde phenylhydrazone; phosphamidophenols; phosphamidoanilines; polyhydroxybenzenes (for example, hydroquinone, t-butylhydroquinone, isopropylhydroquinone, and (2,5-dihydroxy-phenyl) methylsulfone); sulfhydroxamic acids (for example, benzenesulfhydroxamic acid); sulfonamidoanilines (for example, 4-(N-methanesulfonamide)aniline); 2-tetrazolylthiohydroquinones (for example, 2-methyl-5-(1-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; $\alpha$-cyanophenylacetic acid derivatives; combinations of bis-$\beta$-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol, UV-sensitive ascorbic acid derivatives and 3-pyrazolidones. Of these, particularly preferred reducing agents are hindered phenols. As hindered phenols, listed are compounds represented by the general formula (A) described below.

General formula (A)

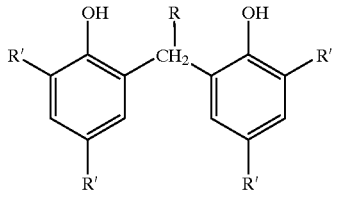

wherein R represents a hydrogen atom or an alkyl group having from 1 to 10 carbon atoms (for example, —$C_4H_9$, 2,4,4-trimethylpentyl), and R' each represents an alkyl group having from 1 to 5 carbon atoms (for example, methyl, ethyl, t-butyl) independently.

Specific examples of the compounds represented by the general formula (A) are described below.

A-1

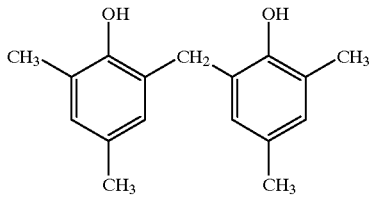

A-2

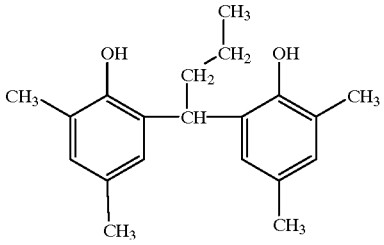

A-3

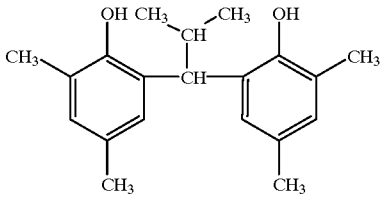

A-4

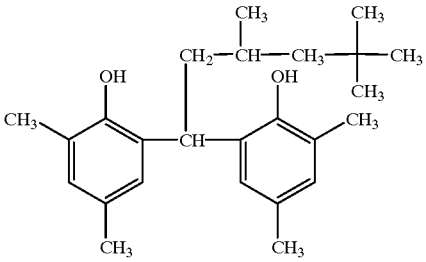

A-5

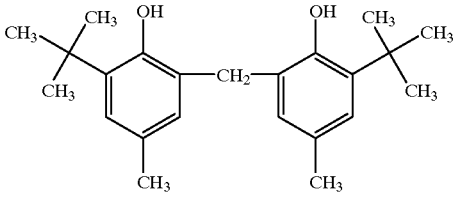

A-6

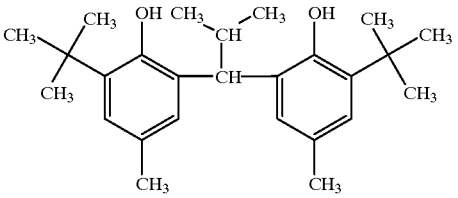

-continued

A-7

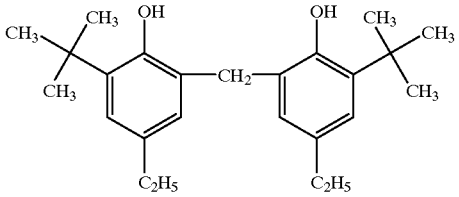

The used amount of reducing agents first represented by the above-mentioned general formula (A) is preferably between $1\times10^{-2}$ and 10 moles per mole of silver, and is most preferably between $1\times10^{-2}$ and 1.5 moles.

Binders suitable for the thermally developable photosensitive material of the present invention are transparent or translucent, and generally colorless. Binders are natural polymers, synthetic resins, and polymers and copolymers, other film forming materials; for example, gelatin, gum arabic, poly(vinyl alcohol), hydroxyethyl cellulose, cellulose acetate, cellulose acetatebutylate, poly(vinyl pyrrolidone), casein, starch, poly(acrylic acid), poly (methylmethacrylic acid), poly(vinyl chloride), poly (methacrylic acid), copoly(styrene-maleic acid anhydride), copoly(styrene-acrylonitrile), copoly(styrene-butadiene), poly(vinyl acetal) series (for example, poly(vinyl formal) and poly(vinyl butyral), poly(ester) series, poly(urethane) series, phenoxy resins, poly(vinylidene chloride), poly (epoxide) series, poly(carbonate) series, poly(vinyl acetate) series, cellulose esters, poly(amide) series. These may be hydrophilic or hydrophobic.

In the present invention, with the purpose of minimizing the size variation after thermal development, the amount of the binder in a photosensitive layer is preferably between 1.5 and 10 $g/m^2$, and is more preferably between 1.7 and 8 $g/m^2$. When the amount is below 1.5 $g/m^2$, the density of an unexposed part markedly increases to occasionally cause no commercial viability.

In the present invention, a matting agent is preferably incorporated into the photosensitive layer side. In order to minimize the image abrasion after thermal development, the matting agent is provided on the surface of a photosensitive material and the matting agent is preferably incorporated in an amount of 0.5 to 10 per cent in weight ratio with respect to the total binder in the emulsion layer side.

Materials of the matting agents employed in the present invention may be either organic or inorganic substances. Regarding inorganic substances, for example, those can be employed as matting agents, which are silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Regarding organic substances, as organic matting agents those can be employed which are starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022, 169.

The shape of the matting agent may be crystalline or amorphous. However, a crystalline and spherical shape is preferably employed. The size of a matting agent is expressed in the diameter of a sphere which has the same volume as the matting agent.

The matting agent employed in the present invention preferably has an average particle diameter of 0.5 to 10 μm, and more preferably of 1.0 to 8.0 μm. Furthermore, the variation coefficient of the size distribution is preferably not more than 50 percent, is more preferably not more than 40 percent, and is most preferably not more than 30 percent.

The variation coefficient of the size distribution as described herein is a value represented by the formula described below.

(Standard deviation of particle diameter)/(average particle diameter)×100

The matting agent according to the present invention can be incorporated into arbitrary construction layers. In order to accomplish the object of the present invention, the matting agent is preferably incorporated into construction layers other than the photosensitive layer, and is more preferably incorporated into the farthest layer from the support surface. Addition methods of the matting agent according to the present include those in which a matting agent is previously dispersed into a coating composition and is then coated, and prior to the completion of drying, a matting agent is sprayed. When a plurality of matting agents are added, both methods may be employed in combination.

The thermally developable photosensitive material of the present invention is subjected to formation of photographic Cimages employing thermal development processing, and preferably comprises a reducible silver source (organic silver salt), silver halide with an catalytically active amount, a hydrazine derivative, a reducing agent and, if desired, an image color control agent, to adjust silver tone, which are generally dispersed into a (an organic) binder matrix.

The thermally developable photosensitive material of the present invention is stable at normal temperatures and is developed, after exposure, when heated to high temperatures (for example, 80 to 140° C.). Upon heating, silver is formed through an oxidation-reduction reaction between the organic silver salt (functioning as an oxidizing agent) and the reducing agent. This oxidation-reduction reaction is accelerated by the catalytic action of a latent image formed in the silver halide through exposure. Silver formed by the reaction with the organic silver salt in an exposed area yields a black image, which contrasts with an unexposed area to form an image. This reaction process proceeds without the further supply of a processing solution such as water, etc. from outside.

The thermally developable photosensitive material of the present invention comprises a support having thereon at least one photosensitive layer, and the photosensitive layer may only be formed on the support. Further, at least one non-photosensitive layer is preferably formed on the photosensitive layer. In order to control the amount or wavelength distribution of light transmitted through the photosensitive layer, a filter layer may be provided on the same side as the photosensitive layer, or on the opposite side. Dyes or pigments may also be incorporated into the photosensitive layer. As the dyes, preferred are compounds described in Japanese Patent Publication Open to Public Inspection No. 8-201,959. The photosensitive layer may be composed of a plurality of layers. Furthermore, for gradation adjustment, in terms of sensitivity, layers may be constituted in such a manner as a fast layer/slow layer or a slow layer/fast layer. Various types of additives may be incorporated into any of a photosensitive layer, a non-photosensitive layer, or other formed layers.

Surface active agents, antioxidants, stabilizers, plasticizers, UV absorbers, covering aids, etc. may be employed in the thermally developable photosensitive material of the present invention.

Image color control agents are preferably incorporated into the thermally developable photosensitive material of the present invention. The image control agents are materials well known in the photographic art, as described in U.S. Pat. Nos. 3,080,254, 3,847,612, and 4,123,282. Examples of suitable image color control agents are disclosed in Research Disclosure Item 17029, and include the following;

imides (for example, phthalimide), cyclic imides, pyrazoline-5-ons, and quinazolinon (for example, succinimide, 3-phenyl-2-pyrazoline-5-on, 1-phenylurazole, quinazoline and 2,4-thiazolidion); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis(isothiuroniumtrifluoroacetate), and 2-(tribromomethylsulfonyl)benzothiazole; merocyanine dyes (for example, 3-ethyl-5-((3-etyl-2-benzothiazolinylidene(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone+benzenesulfinic acid sodium or 8-methylphthalazinone+p-trisulfonic acid sodium); combinations of phthalazine+phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, nartoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a,5,6a-tatraazapentalene). Preferred image color control agents include phthalazone or phthalazine.

In the present invention, in order to control development, namely to retard or accelerate development, to improve the spectral sensitization efficiency, and to improve keeping quality before and after development, mercapto compounds, disulfide compounds, and thione compounds may be incorporated. When the mercapto compounds are used in the present invention, those having any structure may be employed. However, those represented by ArSM and Ar—S—S—Ar are preferred, wherein M represents a hydrogen atom or an alkali metal atom; Ar represents an aromatic ring or a condensed aromatic ring having at least one of a nitrogen, sulfur, oxygen, selenium or tellurium atom. Preferably, the hetero-aromatic ring is benzimidazole, naphthoimidazole, benzothiazole, naphthothiazole, benzoxazole, naphthoxazole, benzoselenazole, benzotelluzole, imidazole, oxazole, pyrazole, triazole, thiadiazole, tetrazole, triazine, pyrimidine, pyridazine, pyrazine, pyridine, purine, quinoline, quinazoline.

This hetero-aromatic ring may comprise any of those selected from the substituent group consisting of, for example, halogen (for example, Br and Cl), hydroxy, amino, carboxy, alkyl (for example, having at least one carbon atom, or having preferably 1 to 4 carbon atoms), and alkoxy (for example, having at least one carbon atom, or having preferably 1 to 4 carbon atoms). Mercapto substituted hetero-aromatic compounds include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobisbenzothiazole, 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4-(3H)-quinazoline, 7-trifluoromethyl-4-quinolinethiol, 2,3,5,6-tetrachloro-4-pyridinethiol, 4-amino-6-hydroxy-2-mercaptopyridimine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 2-mercapto-4-phenyloxazole, etc. However, the present invention is not limited to these compounds. The added amount of these mercapto compounds is preferably in the range of 0.001 to 1.0 mole per mole of silver in an emulsion layer, and is more preferably in the range of 0.01 to 0.3 mole.

The substance which is known as the most effective antifoggant is a mercury ion. The incorporation of mercury compounds as the antifoggant into photosensitive materials is disclosed, for example, in U.S. Pat. No. 3,589,903. However, mercury compounds are not environmentally preferred. As mercury-free antifoggants, preferred are those antifoggants as disclosed in U.S. Pat. Nos. 4,546,075 and 4,452,885, and Japanese Patent Publication Open to Public Inspection No. 59-57234.

Particularly preferred mercury-free antifoggants are heterocyclic compounds having at least one substituent, represented by —C(X1)(X2)(X3) (wherein X1 and X2 each represents halogen, and X3 represents hydrogen or halogen), as disclosed in U.S. Pat. Nos. 3,874,946 and 4,756,999. As examples of suitable antifoggants, employed preferably are compounds and the like, described in paragraph numbers [0062] and [0063] of Japanese Patent Publication Open to Public Inspection No. 9-90550.

Furthermore, more suitable antifoggants are disclosed in U.S. Pat. No. 5,028,523, and European Patent Publication No. 631,176 A.

Into the photosensitive layer of the present invention, incorporated can be polyhydric alcohols as plasticizers and lubricants (for example, such types as glycerines and diols described in U.S. Pat. No. 2,960,404), fatty acids or esters thereof described in U.S. Pat. Nos. 258,765 and 3,121,060, silicone resins described in U.K. Patent No. 955,061, etc.

Hardeners may be incorporated into each of the photosensitive layer, protective layer, backing layer, etc. of the present invention. As examples of the hardeners, employed are isocyanate compounds, epoxy compounds described in U.S. Pat. No. 4,910,042, etc., vinyl sulfone series compounds described in Japanese Patent Publication Open to Public Inspection No. 62-89048, etc.

With the purpose of improvements in coating properties and static properties, surface active agents may be employed. As examples of the surface active agents, any of those may be suitably employed, which are comprised of anionic series, cationic series, betaine series, nonionic series, fluorine series, etc. Specifically, listed are fluorine series high polymer surface active agents described in Japanese Patent Publication Open to Public Inspection No. 62-170950, U.S. Pat. No. 5,382,504, etc., fluorine series surface active agents described in Japanese Patent Publication Open to Public Inspection Nos. 60-244945, 63-188135, etc., polysiloxane series surface active agents described in U.S. Pat. No. 3,885,965, etc., polyalkylene oxide and anionic surface active agents described in Japanese Patent Publication Open to Public Inspection No. 6-301140, etc.

The thermally developable photographic emulsion in the present invention may be coated employing various coating methods, which include a dip coating method, an air knife coating method, a flow coating method, or an extrusion coating method which employs the types of the hoppers described in U.S. Pat. No. 2,681,294. If desired, two or more layers can be simultaneously coated employing the methods described in U.S. Pat. No. 2,761,791 and U.K. Patent No. 837,095.

Supports employed in the present invention are preferably, in order to obtain predetermined optical density after development processing and to minimize the deformation of images after development processing, plastic films (for example, polyethylene terephthalate, polycarbonate, polyimide, nylon, cellulose triacetate, polyethylene naphthalate).

Of these, as preferred supports, listed are polyethylene terephthalate (hereinafter referred to as PET), polyethylene naphthalate (hereinafter referred to as PEN, and plastics (hereinafter referred to as SPS) comprising styrene series polymers having a syndioctatic structure. The thickness of the support is between about 50 and about 300 $\mu$m, and is preferably between 70 and 180 $\mu$m.

Furthermore, thermally processed plastic supports may be employed. As acceptable plastics, those described above are listed. The thermal processing of the support, as described herein, is that after film casting and prior to the photosensitive layer coating, these supports are heated to a temperature at least 30° C. higher than the glass transition point and more preferably by at least 35° C., and most preferably by at least 40° C. However, when the supports are heated at a temperature higher than the melting point, no advantages of the present invention are obtained.

Plastics employed in the present invention are described below.

PET is a plastic in which all the polyester components are composed of polyethylene terephthalate. However, other than polyethylene terephthalate, employed also may be polyesters in which modified polyester components such as acid components, terephthalic acid, naphthalene-2,6-dicaroxylic acid, isophthalic acid, butylenecarboxylic acid, 5-sodiumsulfoisophthalic acid, adipic acid, etc., and as glycol components, ethylene glycol, propylene glycol, butanediol, cyclohexane dimethanol, etc. may be contained in an amount of no more than 10 mole percent, with respect to the total polyester content.

As PEN, preferred are polyethylene 2,6-naphthalate and copolymerization polyesters comprised of terephthalic acid and 2–6 naphthalene dicarboxylic acid and ethylene glycol, and polyesters which comprise at least two mixtures of these as a main constituting component. Furthermore, other copolymerizable components may be copolymerized and other polyesters may be mixed.

SPS is different from normal polystyrene (atactic polystyrene) and a polystyrene having stereoregularity. The stereoregular structure portion of SPS is termed a racemo chain and the more regular parts increase as 2 chains, 3 chains, 5 chains or more chains, the higher being, the more preferred. In the present invention, the racemo chains are preferably not less than 85 percent for two chains, not less than 75 percent for three chains, not less than 50 percent for five chains, and 30 percent for chains more than that. SPS can be polymerized in accordance with a method described in Japanese Patent Publication Open to Public Inspection No. 3-131843.

As the base casting method of the support and subbing production method which are associated with the present invention, any of those known in the art can be employed. However, those methods described in paragraphs [0030] through [0070] of Japanese Patent Publication Open to Public Inspection No. 9-50094 are preferably employed.

EFFECTS OF THE INVENTION

As described above, in the invention described in claim 1, with employing a thermally developable photosensitive material which basically comprises photosensitive silver halide, a non-photosensitive reducible silver source, and a reducing agent for the silver source, the above-mentioned image signals are converted into variation in light intensity; are recorded onto photosensitive silver halide grains, and are thermally developed in the presence of the non-photosensitive reducible silver source and the reducing agent for the silver source to quickly and surely obtain high quality x-ray images with excellent sharpness and high resolution which are required, for example, for mammography or x-ray photographs of the limbs, bones, etc.

In the invention described in claim 2, an x-ray image is recorded onto photosensitive silver halide grains; heating is carried out in the presence of a non-photosensitive reducible silver source and a reducing agent for the silver source; the thermally developable photosensitive material is thermally developed employing a thermal development device, to quickly and surely obtain a high quality x-ray image with excellent sharpness and high resolution required for, for example, mammography and radiography of the limbs, bones, etc., moreover employing a low cost device.

In the invention described in claim 3, a thermally developable photosensitive material is conveyed and exposure is given onto photosensitive silver halide grains for recording; heating is carried out in the presence of a non-photosensitive reducible silver source and a reducing agent for the silver source; the thermally developable photosensitive material is thermally developed to make it possible to quickly and surely obtain a high quality x-ray image with excellent sharpness and high resolution required for, for example, mammography and radiography of the limbs, bones, etc., moreover employing a low cost device.

What is claimed is:

1. An x-ray image forming method of the invention comprising steps of;

capturing an x-ray image by a flat panel detector, reading out an x-ray image from the flat panel detector in the form of an image signal, converting the image signal to light signal, exposing a thermally developable photosensitive material comprising light sensitive silver halide grains, a non-photosensitive reducible silver source and a reducing agent for the silver source according to the light signal, and heating the exposed thermally developable photosensitive material to obtain an x-ray image, wherein the reducing agent is a compound represented by formula

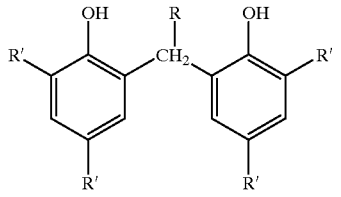

wherein R represents a hydrogen atom or an alkyl group having from 1 to 10 carbon atoms, and R' each represent an alkyl group having from 1 to 5 carbon atoms independently.

2. An x-ray image forming method of claim 1 wherein the thermally developable photosensitive material comprises a support having thereon at least one photosensitive layer comprising the light sensitive silver halide grains.

3. The x-ray image forming method of claim 2, wherein the photosensitive layer comprises the non-photosensitive reducible silver source, the reducing agent and a binder.

4. An x-ray image forming method of claim 3 wherein the thermally developable photosensitive material comprises a matting agent at a side having the photosensitive layer.

5. An x-ray image forming method of claim 4 wherein the matting agent has an average particle diameter of 0.5 to 10 $\mu$m.

6. An x-ray image forming method of claim 4 wherein heating temperature is 80 to 140° C.

7. An x-ray image forming method of claim 2 wherein an amount of the binder in a photosensitive layer is between 1.5 and 10 g/m$^2$.

8. An x-ray image forming method of claim 2 wherein an average grain size of photosensitive silver halide grains is not more than 0.1 $\mu$m.

9. An x-ray image forming method of claim 2 wherein the non-photosensitive reducible silver source is an organic silver salt.

10. An x-ray image forming method of claims 9 wherein the organic silver salt is needle crystal.

11. An x-ray image forming method of claim 10 wherein short axis is 0.01 to 0.20 $\mu$m and long axis is 0.10 to 5.0 $\mu$m.

12. An x-ray image forming method of claim 1 wherein an amount of the reducing is $1\times10^{-2}$ to 10 moles per mole of silver.

13. The x-ray image forming method of claim 1, wherein the flat panel detector comprises a dielectric substrate, a photoconductive layer, a dielectric layer and a front surface conductive layer.

14. The x-ray image forming method of claim 13, wherein the flat panel detector comprises conductive electrode micro-plate on the substrate.

15. The x-ray image forming method of claim 13, wherein the photoconductive layer comprises a conductive electrode microplate.

16. The x-ray image forming system of claim 15, wherein the flat panel detector comprises a dielectric substrate, a photoconductive layer, a dielectric layer and a front surface conductive layer in this order.

17. An x-ray image forming method comprising steps of:

capturing an x-ray image by a flat panel detector, reading out an x-ray image from the flat panel detector in the form of an image signal, converting the image signal to light signal, exposing a thermally developable photosensitive material, and heating the exposed thermally developable photosensitive material to obtain an x-ray image, wherein the thermally developable photosensitive material comprises a photosensitive layer provided on a side of a support and a matting agent having an average particle diameter of 0.5 to 10 $\mu$m on the side of the support having the photosensitive layer, the photosensitive layer comprising light sensitive silver halide grains, a non-photosensitive reducible silver source, a reducing agent for the silver source according to the light signal and a binder.

18. An x-ray image forming system comprising:

a flat panel detector which captures an x-ray image, reading device to take out an x-ray image from the flat panel detector in the form of an image signal, a converting device which converts the image signal to light signal, an exposing device which exposes a thermally developable photosensitive material comprising light sensitive silver halide grains, a non-photosensitive reducible silver source and a reducing agent for the silver source according to the light signal, and a heating device which thermally develops the exposed thermally developable photosensitive material, wherein the reducing agent is a compound represented by formula

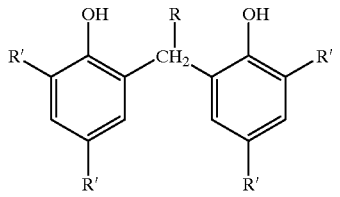

wherein R represents a hydrogen atom or an alkyl group having from 1 to 10 carbon atoms, and R' each represent an alkyl group having from 1 to 5 carbon atoms independently.

19. The x-ray image forming system of claim 18 wherein the system comprises;

a conveyance device which conveys a thermally developable photosensitive material, and a control device which controls said conveyance device, said exposure device, and said heating device.

20. The x-ray image forming system of claim 18, wherein the flat panel detector comprises a dielectric substrate, a photoconductive layer, a dielectric layer and a front surface conductive layer.

* * * * *